US008104875B2

(12) United States Patent
Nagata

(10) Patent No.: US 8,104,875 B2
(45) Date of Patent: Jan. 31, 2012

(54) LIQUID JET RECORDING HEAD

(75) Inventor: Shingo Nagata, Kawasaki (JP)

(73) Assignee: Canon Kabushuiki Kaisha, Tokyo (JP)

( * ) Notice: Subject to any disclaimer, the term of this patent is extended or adjusted under 35 U.S.C. 154(b) by 375 days.

(21) Appl. No.: 12/509,357

(22) Filed: Jul. 24, 2009

(65) Prior Publication Data

US 2010/0026766 A1 Feb. 4, 2010

(30) Foreign Application Priority Data

Jul. 29, 2008 (JP) ..... 2008-194874

(51) Int. Cl.
*B41J 2/05* (2006.01)

(52) U.S. Cl. ..... 347/63; 347/44; 347/56

(58) Field of Classification Search ..... 347/20, 347/44, 47, 56, 6–65, 67
See application file for complete search history.

(56) References Cited

U.S. PATENT DOCUMENTS 6,799,831 B2 * 10/2004 Inamoto et al. ..... 347/44
2003/0048328 A1 3/2003 Inamoto

FOREIGN PATENT DOCUMENTS

JP 10-157150 A 6/1998
JP 11-138817 A 5/1999
JP 2003-80717 A 3/2003

* cited by examiner

*Primary Examiner* — Juanita D Stephens
(74) *Attorney, Agent, or Firm* — Canon U.S.A., Inc. IP Division

(57) ABSTRACT

A liquid jet recording head includes a substrate on which are formed recording elements that generate energy for ejecting liquid, and a flow passage forming member that is in contact with the substrate and in which are formed ejection ports that eject liquid and flow passages that supply liquid to the ejection ports. The flow passage forming member has a groove formed along the longitudinal direction of the flow passage forming member, and each end of the groove is located nearer to the middle in the width direction of the flow passage forming member than the other part of the groove is.

5 Claims, 12 Drawing Sheets

LIQUID JET RECORDING HEAD

BACKGROUND OF THE INVENTION

1. Field of the Invention

The present invention relates to a liquid jet recording head that ejects liquid such as ink onto a recording material such as recording paper and thereby performs a recording operation.

2. Description of the Related Art

As a typical liquid ejecting technology in use in liquid jet recording heads, there is known a technology in which ink is heated by an electro-thermal conversion element having a heating resistor, and ink is ejected by the action of film boiling. In a liquid jet recording head using electro-thermal conversion elements, the electro-thermal conversion elements are provided in liquid chambers filled with ink. By supplying the electro-thermal conversion elements with an electric pulse serving as a recording signal, and making the electro-thermal conversion elements generate heat, ink is provided with thermal energy. A change of phase of ink causes bubbling (boiling) of ink. Using the bubble pressure, ink is ejected through ink ejection ports, and recording is thereby performed on a recording material. An ink jet recording apparatus having such a bubble jet recording head that causes film boiling in ink and ejects ink using expansion and contraction of a bubble, can output high-quality characters and/or images at low cost.

Such a liquid jet recording head is configured by joining an orifice plate having a plurality of ink ejection ports, to a substrate. In the middle of the substrate is formed an ink supply port for supplying ink to the orifice plate. On the surface of the substrate to which the orifice plate is joined, are provided a plurality of electro-thermal conversion elements corresponding to the ink ejection ports. The ink supply port is connected with the ink ejection ports above the electro-thermal conversion elements by ink flow passages. Ink is supplied from the ink supply port to the ink flow passages, and is ejected through the ink ejection ports by the pressure of bubbles generated by the action of the electro-thermal conversion elements.

Such a method for making a liquid jet recording head is disclosed in Japanese Patent Laid-Open Nos. 10-157150 and 11-138817. Specifically, first, a soluble resin layer is formed on a substrate on which electro-thermal conversion elements are formed. Next, on this resin layer, a covering resin layer constituting an orifice plate is formed, for example, by spin coating. Next, ink ejection ports are formed in the covering resin layer. Finally, an ink supply port is formed in the substrate, and the soluble resin layer is dissolved. The dissolved parts serve as ink flow passages that connect the ink supply port with the ink ejection ports above the electro-thermal conversion elements.

In a liquid jet recording head made as above, the orifice plate is significantly stressed, for example, by contraction of the covering resin layer due to thermal hardening, and the orifice plate is prone to peel from the substrate. Such peeling becomes significant with increasing length of the liquid jet recording head or increasing thickness of the orifice plate.

A measure against such peeling of the orifice plate from the substrate is disclosed in Japanese Patent Laid-Open No. 2003-80717. Specifically, a groove is provided in the orifice plate to reduce the volume of the orifice plate, to reduce the stress on the orifice plate, and to make peeling unlikely. Making the shape of the groove saw-toothed is also effective in making peeling unlikely.

As described above, reducing the absolute volume of the orifice plate by providing a groove in the orifice plate is effective against peeling of the orifice plate from the substrate. However, when a groove is provided in the orifice plate, each end of the groove is significantly stressed. In some cases, slight peeling can occur at each end of the groove. Similarly, the edge of the orifice plate is also significantly stressed. In some cases, slight peeling can occur. If a peeling at one end of the groove and a peeling at the edge of the orifice plate join, this can develop into a larger peeling.

That is, when providing a groove in the orifice plate, attention needs to be paid to the position of each end of the groove. In particular, when at the edge of the substrate is provided a test terminal for measuring the characteristics of a circuit for driving the electro-thermal conversion elements, peeling of the orifice plate from the substrate near the test terminal is undesirable. Basically, the test terminal is covered by the orifice plate so as not to be exposed to ink and/or moisture.

When an electrode for supplying electric power to electric wiring is located near the test terminal, the area is sealed with a sealing material that consists primarily of epoxy resin. As a result, the edge of the orifice plate is often covered with the sealing material. However, when the edge of the orifice plate peels from the substrate, and when the peeling edge of the orifice plate is not sufficiently covered with the sealing material, there is a possibility that the test terminal can be exposed to ink and/or moisture. The test terminal often has a large potential difference relative to GND (ground), and contact with ink and/or humidity can lead to corrosion. However, corrosion does not instantaneously affect the performance of the liquid jet recording head.

SUMMARY OF THE INVENTION

The present invention provides a liquid jet recording head having improved reliability by relaxing the stress at the edge of the orifice plate.

In an aspect of the present invention, a liquid jet recording head includes a substrate on which are formed recording elements that generate energy for ejecting liquid, and a flow passage forming member that is in contact with the substrate and in which are formed ejection ports that eject liquid and flow passages that supply liquid to the ejection ports. The flow passage forming member has a groove formed along the longitudinal direction of the flow passage forming member, and each end of the groove is located nearer to the middle in the width direction of the flow passage forming member than the other part of the groove is.

Further features of the present invention will become apparent from the following description of exemplary embodiments with reference to the attached drawings.

DESCRIPTION OF THE EMBODIMENTS

The embodiments of the present invention will now be described with reference to the drawings.

Figure 2A:
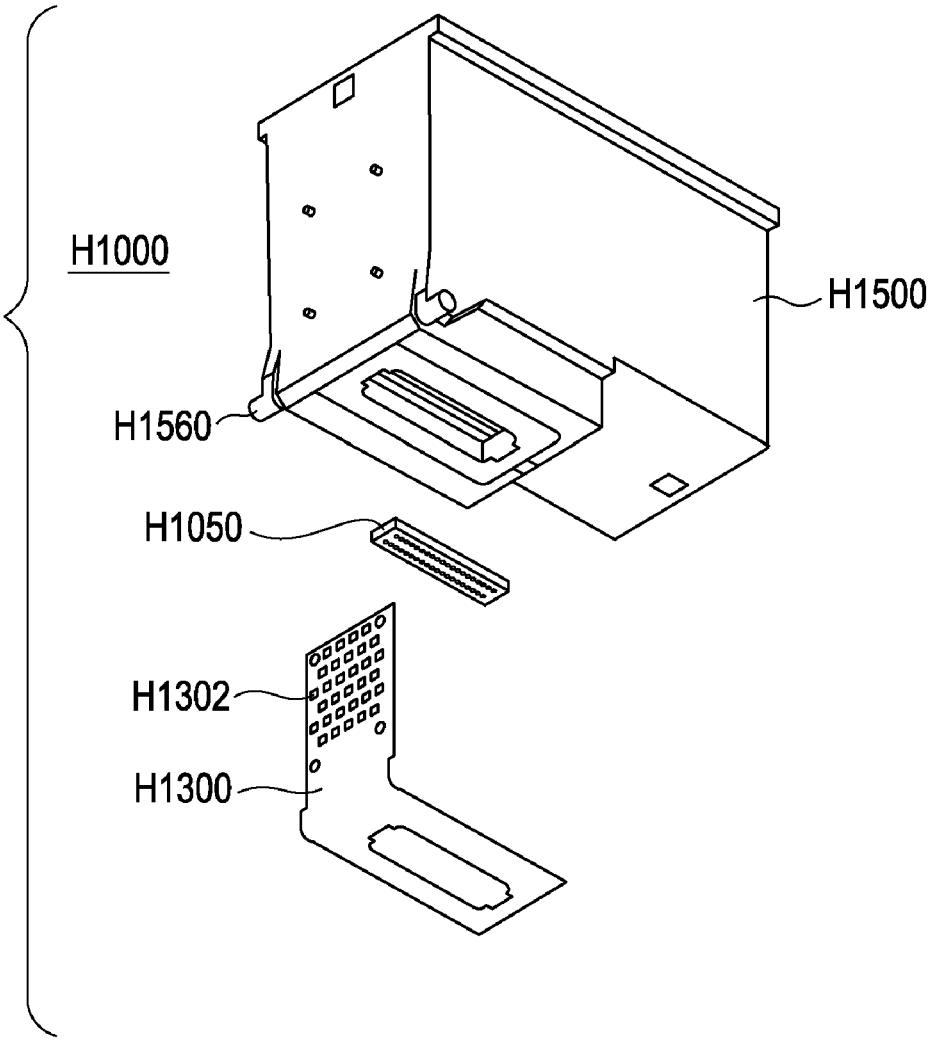
FIGS. 2A and 2B are exploded perspective views showing a liquid jet recording head.
Figure 2B:
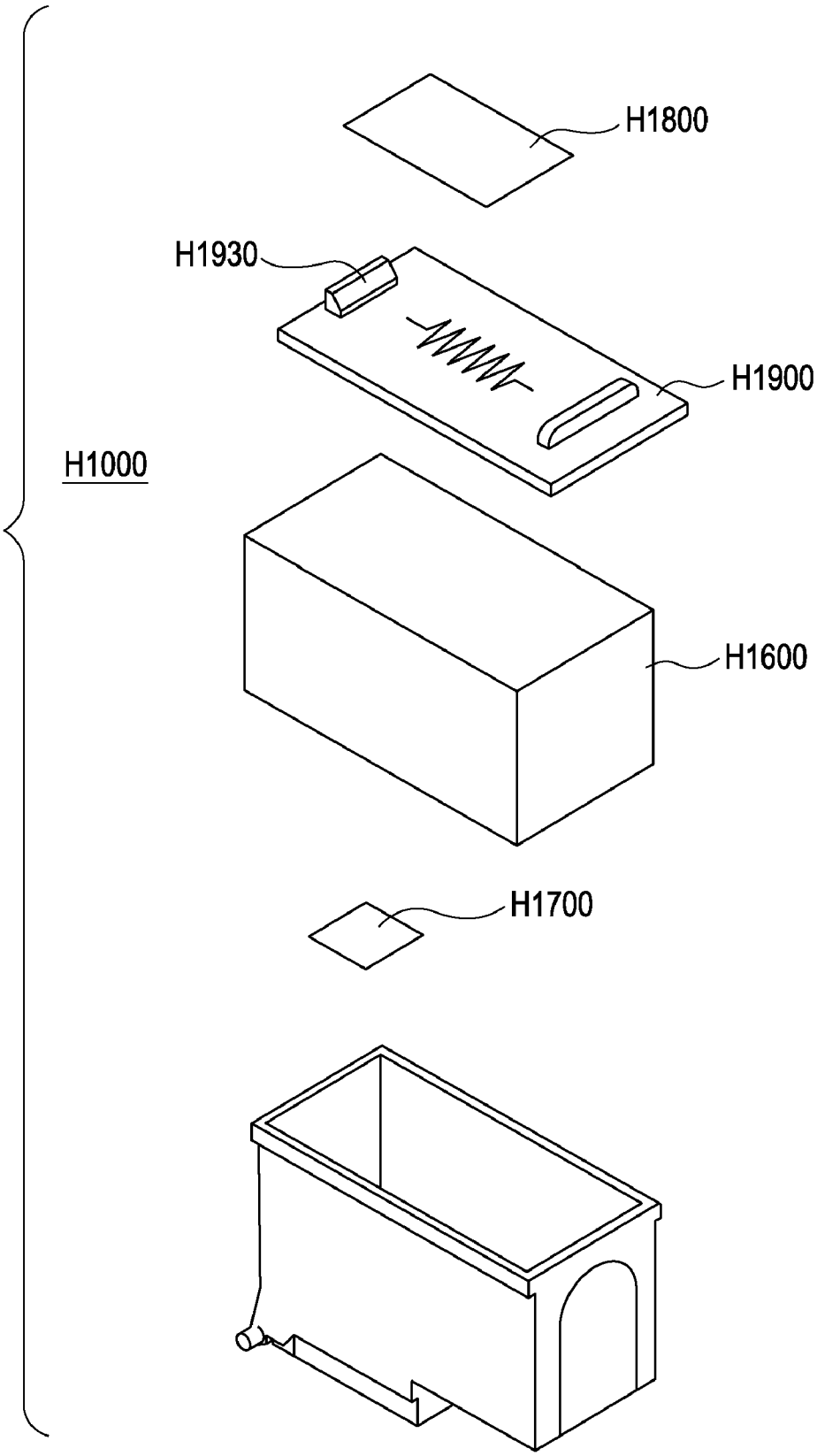
Figure 3:
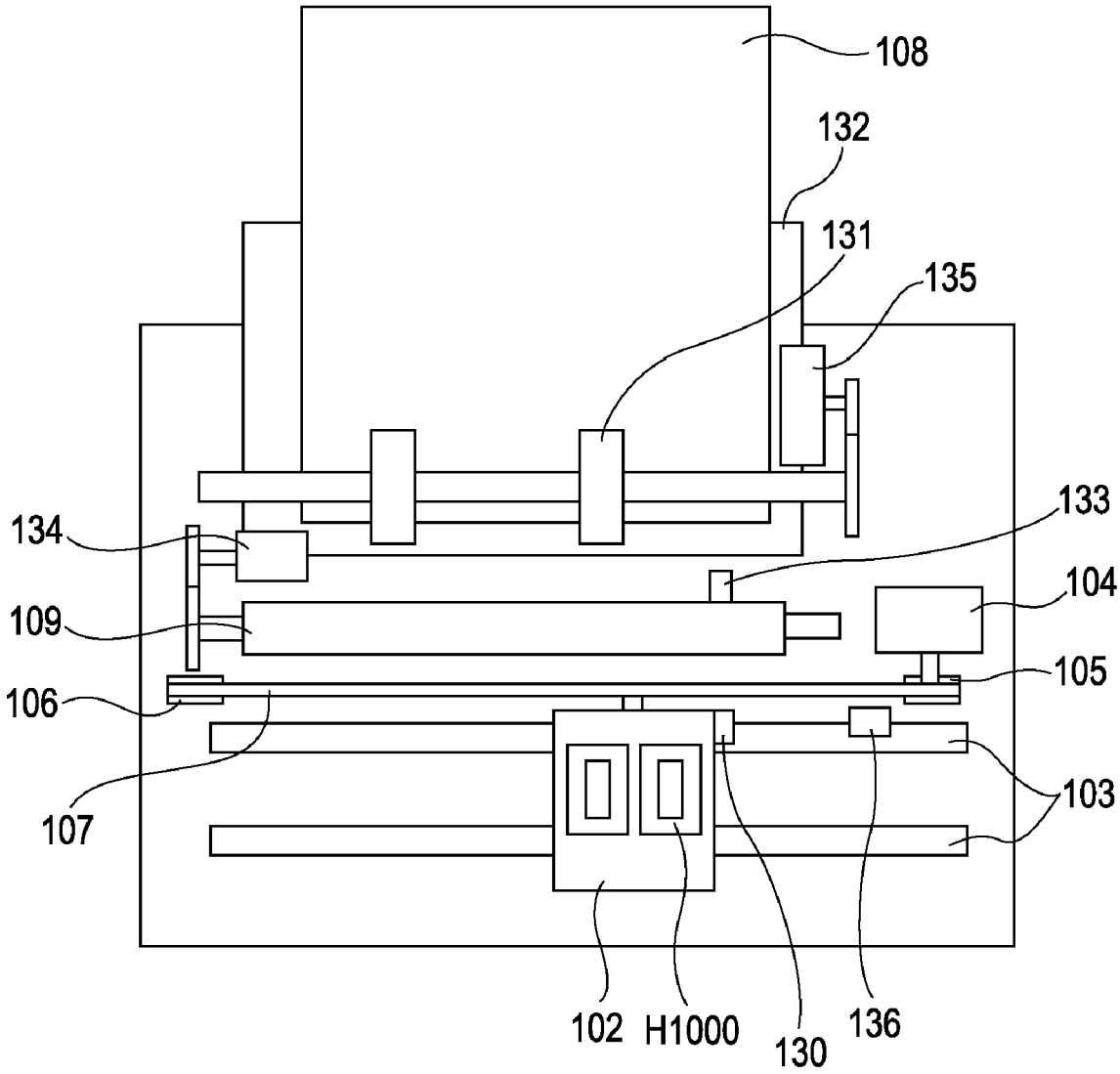
FIG. 3 is a plan view showing an ink jet recording apparatus.

FIGS. 1 to 3 are illustrations of a liquid jet recording head to which the present invention is applied. With reference to these figures, each component will be described.

(1) Liquid Jet Recording Head

The liquid jet recording head H1000 of this embodiment is a bubble jet (registered trademark) recording head that uses electro-thermal conversion elements that generate thermal energy for causing film boiling in ink in response to an electric signal. This liquid jet recording head H1000 is a so-called side shooter type recording head in which electro-thermal conversion elements and ink ejection ports that eject ink droplets are disposed so as to face each other.

The liquid jet recording head H1000 ejects black ink. As shown in FIGS. 2A and 2B, this recording head H1000 has a recording element substrate H1050, an electric wiring tape H1300, an ink supplying and holding member H1500, a filter H1700, an ink absorber H1600, a lid member H1900, and a seal member H1800.

When the above-described cartridge type liquid jet recording head is distributed, a protective tape (not shown) is put so as to cover ink ejection ports provided in the recording element substrate H1050.

(2) Installation of Liquid Jet Recording Head in Ink Jet Recording Apparatus

Figure 1A:
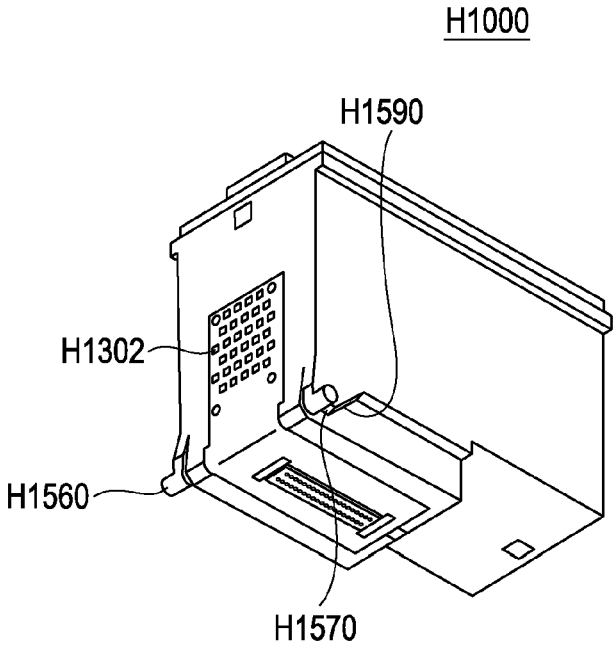
FIGS. 1A and 1B are perspective views showing a liquid jet recording head.
Figure 1B:
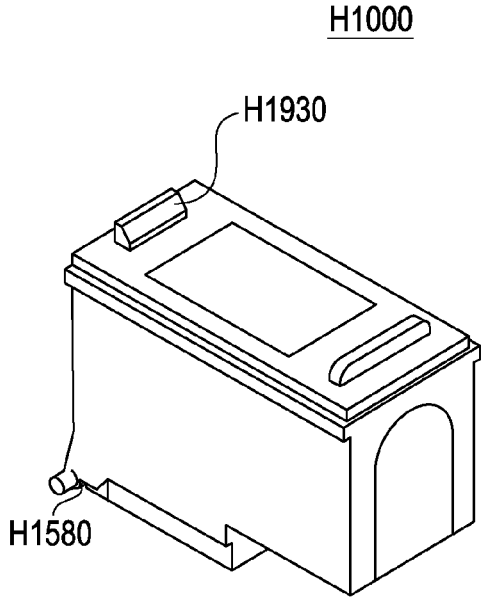

As shown in FIGS. 1A and 1B, the liquid jet recording head H1000 has an installation guide H1560 for guiding to an installation position in a carriage of a main body of a recording apparatus, and an engaging portion H1930 for fixing to the carriage using a head setting lever. The liquid jet recording head H1000 further has an abutment portion H1570 in the X direction (carriage scan direction) and an abutment portion H1580 in the Y direction (recording material conveying direction) for positioning in a predetermined installation position in the carriage. The liquid jet recording head H1000 further has an abutment portion H1590 in the Z direction (ink ejecting direction). By positioning the head using the above abutment portions, external signal input terminals H1302 on the electric wiring tape H1300 are accurately electrically connected with contact pins of an electric connector provided in the carriage.

(3) Ink Jet Recording Apparatus

Next, an ink jet recording apparatus in which the above-described cartridge type liquid jet recording head can be mounted will be described. FIG. 3 is an illustration of an example of a recording apparatus in which the liquid jet recording head can be mounted.

In the recording apparatus shown in FIG. 3, the liquid jet recording head H1000 shown in FIGS. 1A and 1B is positioned and replaceably mounted in a carriage 102. The carriage 102 is provided with an electric connector for transmitting a drive signal to each electro-thermal conversion element through the external signal input terminals on the liquid jet recording head H1000.

The carriage 102 is guided and supported so as to be able to reciprocate along guide shafts 103 that are provided in the main body of the apparatus and extend in the main scanning direction. The carriage 102 is driven and the position and movement thereof are controlled by a main scanning motor 104 via drive mechanisms such as a motor pulley 105, a driven pulley 106, and a timing belt 107. The carriage 102 is further provided with a home position sensor 130. This makes it possible to detect that the home position sensor 130 on the carriage 102 passes a shield plate 136.

Recording materials 108 such as sheets of recording paper or plastic sheets are separated one at a time from an automatic sheet feeder (ASF) 132 by rotating pickup rollers 131 with a feeding motor 135 via gears. By rotating a conveying roller 109, the recording material is conveyed (sub-scanned) through a position (printing portion) facing the ejection surface of the liquid jet recording head H1000. The conveying roller 109 is rotated by an LF motor 134 via gears. Determination whether paper has been fed and determination of the beginning position at the time of feeding are performed when the recording material 108 passes the paper end sensor 133. The paper end sensor 133 is also used for detecting where the trailing edge of the recording material 108 actually is and finally determining the present recording position from the actual trailing edge.

The recording material 108 is supported from below by a platen (not shown) so as to form a flat printing surface in the printing portion. The liquid jet recording head H1000 mounted on the carriage 102 is held so that its ejection port surface protrudes downward from the carriage 102 and is parallel to the recording material 108 between two pairs of conveying rollers.

The liquid jet recording head H1000 is mounted on the carriage 102 so that the arrangement direction of the ink ejection ports intersects with the scanning direction of the carriage 102. Ink is ejected from these ink ejection ports, and recording is thereby performed.

COMPARATIVE EXAMPLE

A comparative example for comparing the effect of the present invention will be described.

Figure 4A:
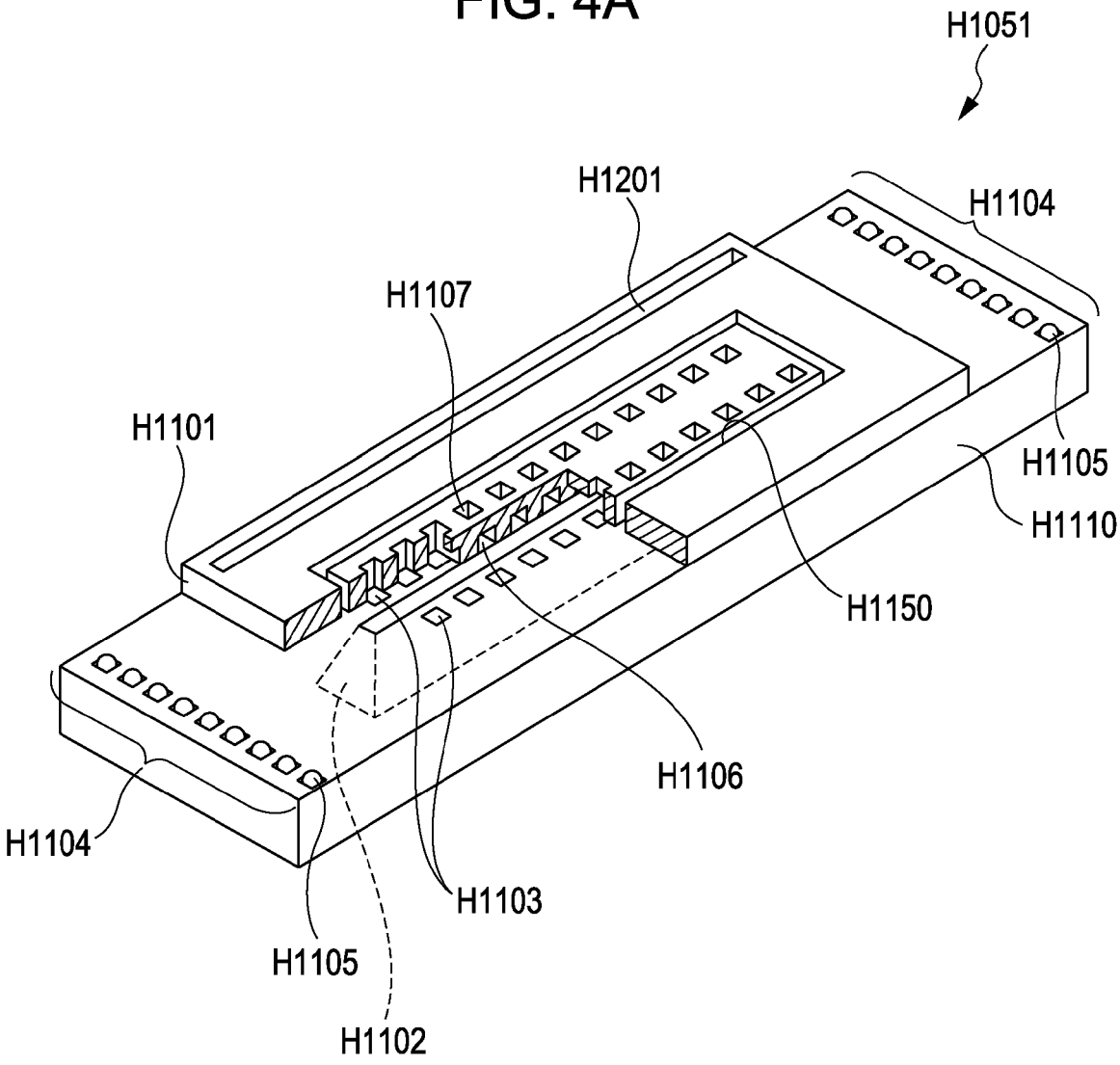
FIGS. 4A to 4C are illustrations of a liquid jet recording head of a comparative example.

FIG. 4A is a partially cutaway perspective view for illustrating the configuration of a recording element substrate H1051 of a comparative example. The recording element substrate H1051 is composed of a substrate H1110 on which electro-thermal conversion elements H1103 are arranged, and a rectangular orifice plate H1101. In the substrate H1110, an ink supply port H1102 that is an elongate through-hole is formed by anisotropic etching using the crystal orientation of silicon, or sandblasting. On the substrate H1110 is the orifice plate H1101. The orifice plate H1101 is formed of a resin material and has ink flow passage walls H1106 and ink ejection ports H1107 formed by photolithographic technique. In the orifice plate H1101, a groove H1150 is provided so as to surround the ink ejection ports H1107 and ink flow passages (not shown). The groove H1150 is provided to prevent the walls forming the ink flow passages from peeling from the substrate, by relaxing the stress in the vicinities of the ink flow passages.

On the substrate H1110 are formed electric wiring (not shown), for example, of aluminum, a fuse (not shown), electrodes H1104, and so forth. In the electrodes H1104 for supplying electric power to the electric wiring, bumps H1105 are formed, for example, of gold. In the vicinity of one edge parallel to the longitudinal direction of the orifice plate H1101, is provided a groove H1201. The groove H1201 has a width of about 30 μm.

Figure 4B:
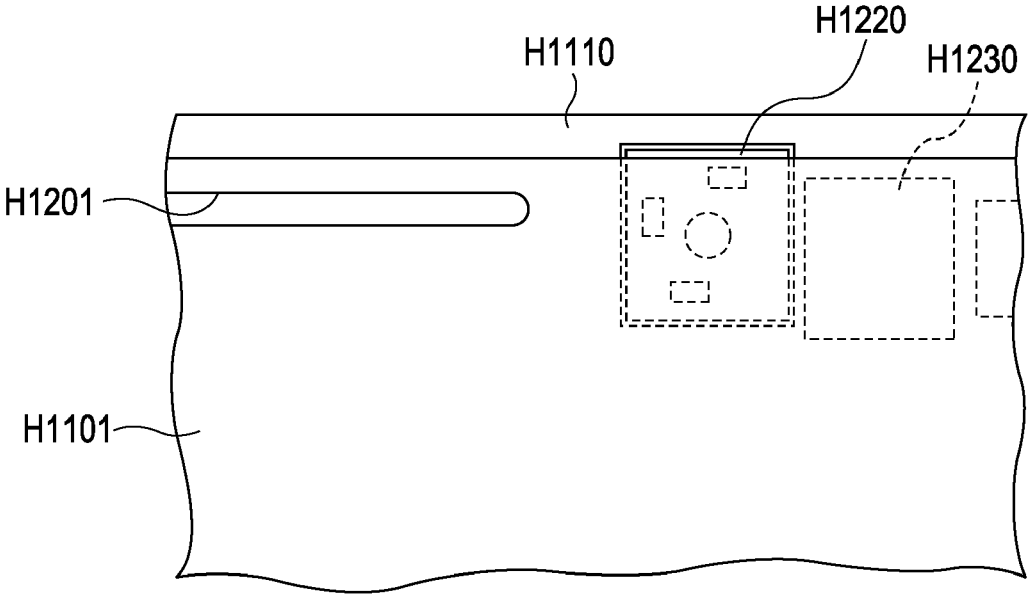

FIG. 4B is a top view of the vicinity of one end in the longitudinal direction of the recording element substrate H1051. The substrate H1110 is provided with an alignment mark H1220. The alignment mark H1220 is used for positioning when the recording element substrate H1051 is joined to an ink supplying and holding member. Next to the alignment mark H1220 is provided a test terminal H1230 for measuring the characteristics of a circuit for driving, for example, the electro-thermal conversion elements H1103.

A liquid jet recording head was made using such a recording element substrate H1051. After making, the head was checked for peeling of the orifice plate H1101 from the substrate H1110. No large peeling was observed. The head was further checked in more detail. Minute peeling was observed at each end of the groove H1201 and at the edge of the orifice plate H1101. The surface of such a liquid jet recording head was soaked in black ink containing carbon black pigment as color material, and was left for five days under an environment at a temperature of 60° C. and at a humidity of 90%. Next, the liquid jet recording head was left for 300 hours under an environment at a temperature of 60° C. and at a humidity of 90% with a voltage of 24 V applied to the test terminal. After that, the test terminal was checked in detail, and slight corrosion was observed on the test terminal.

Figure 4C:
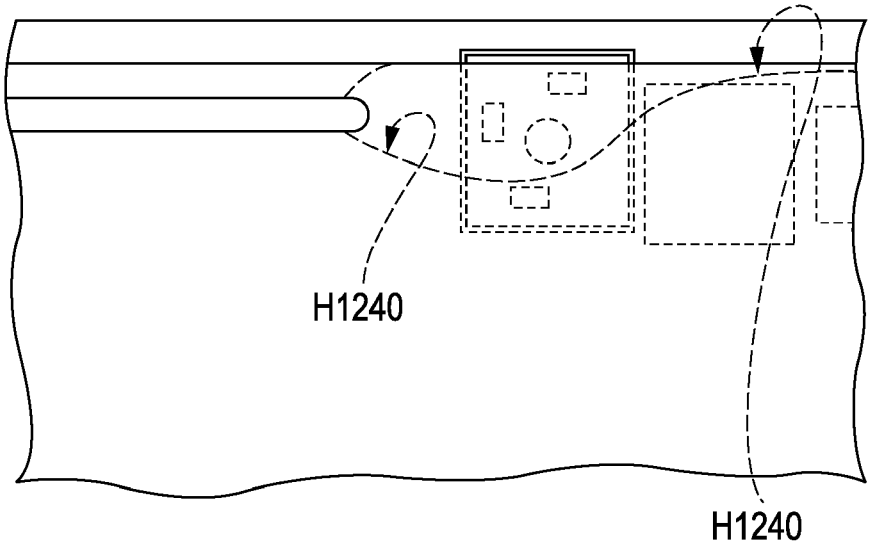

FIG. 4C is a top view of the test terminal, on which slight corrosion was observed, and its vicinity of the recording element substrate H1051 after the test. Peeling H1240 of the orifice plate H1101 from the substrate H1110 was observed. It was also observed that the peeling H1240 extended from the edge of the orifice plate H1101 to the test terminal. That is, the corrosion is attributed to the fact that ink and/or moisture entered through the peeling area at the edge of the orifice plate H1101, and the test terminal is exposed thereto. It is inferred that a peeling at the edge of the orifice plate H1101 and a peeling at the end of the groove H1201 joined during the test and formed a large peeling extending from the edge of the orifice plate H1101 to the test terminal. To prevent such a peeling, it is desirable to dispose the end of the groove H1201 away from the edge of the orifice plate H1101.

First Embodiment

In this embodiment, in consideration of the above-described problems, each end of the groove formed in the orifice plate is located nearer to the middle of the orifice plate than the other part of the groove is. The test terminal was checked for corrosion.

Figure 5A:
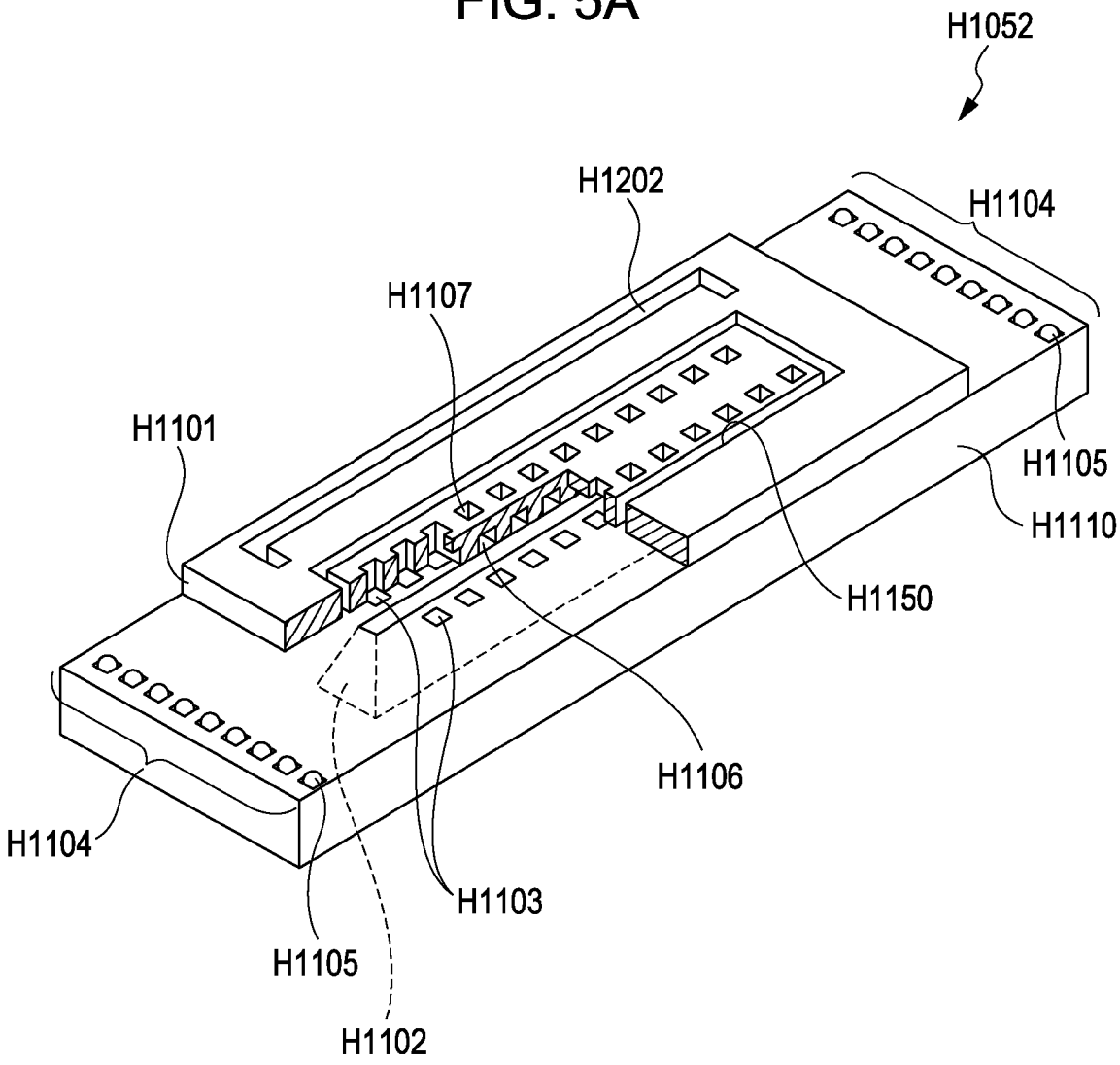
FIGS. 5A to 5C are illustrations of a liquid jet recording head of a first embodiment.

FIG. 5A is a partially cutaway perspective view for illustrating the configuration of a recording element substrate H1052 of this embodiment. The basic configuration is the same as that shown FIG. 4A. The orifice plate H1101 is provided with ink ejection ports H1107. The ink ejection ports H1107 have a diameter of about 21.7 μm. The orifice plate H1101 is about 52 μm thick in the ink flow passage (not shown) portion and about 70 μm thick in the other portion. That is, the orifice plate H1101 has a thickness of 30 μm or more. The stress generated in the orifice plate has a significant impact when the thickness is 30 μm or more, and therefore it is desirable to apply the present invention to an orifice plate having a thickness of 30 μm or more.

The substrate H1110 is provided with electro-thermal conversion elements H1103. The electro-thermal conversion elements H1103 are rectangular, about 34.8 μm wide by about 37.2 μm long. The orifice plate H1101 has ink ejection ports H1107 provided just above the electro-thermal conversion elements H1103.

The orifice plate H1101 further has a rectangular frame-like groove H1150 provided so as to surround the ink ejection ports H1107 and ink flow passages (not shown). Further, in the vicinity of one edge along the longitudinal direction of the orifice plate H1101, a groove H1202 for preventing peeling from the substrate H1110 is formed along the longitudinal direction of the orifice plate H1101. That is, the edge of the groove H1202 is located in the vicinity of the edge along the longitudinal direction of the orifice plate H1101.

One end of the groove H1202 is located at one end in the longitudinal direction of the orifice plate H1101, and the other end of the groove H1202 is located at the other end in the longitudinal direction of the orifice plate H1101. Each end of the groove H1202 is bent and extended in the direction perpendicular to the longitudinal direction of the orifice plate so as to be located nearer to the middle in the width direction of the orifice plate H1101 than the other part of the groove H1202 is. The groove H1202 has a width of about 30 μm.

Figure 5B:
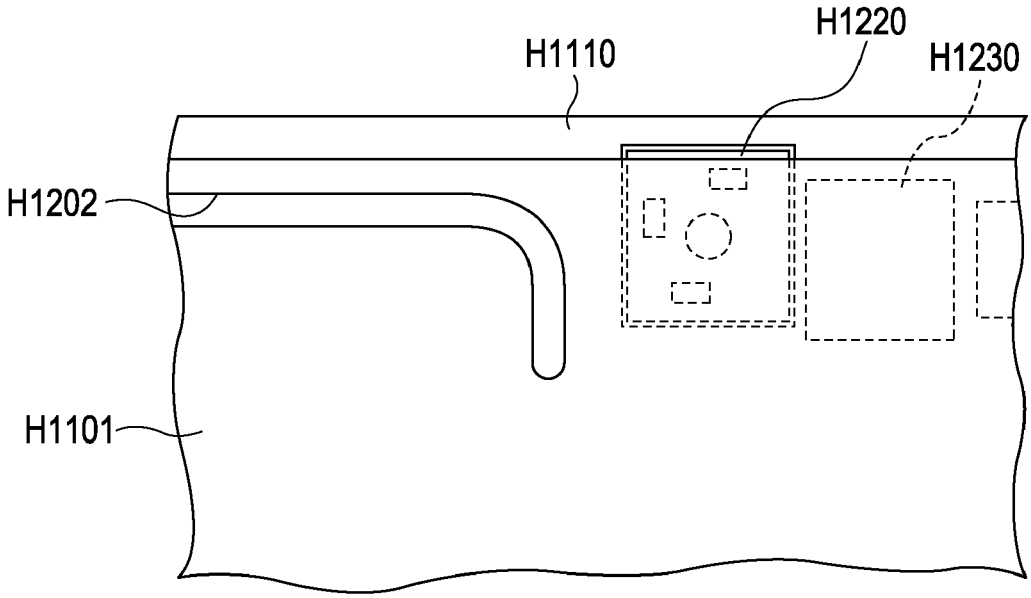

FIG. 5B is a top view of the vicinity of one end in the longitudinal direction of the recording element substrate H1052. The substrate H1110 is provided with an alignment mark H1220. Next to the alignment mark H1220 is provided a test terminal H1230 for measuring the characteristics of a circuit for driving, for example, the electro-thermal conversion elements H1103.

Figure 5C:
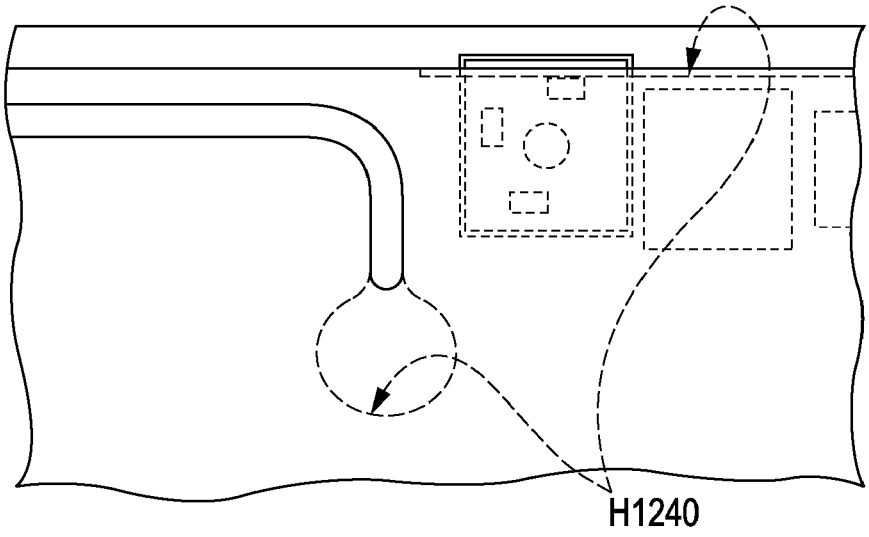

A liquid jet recording head was made using the recording element substrate H1052 configured as above. After making, the head was checked for peeling of the orifice plate H1101 from the substrate H1110. No large peeling was observed. The head was further checked in more detail. Minute peeling was observed at each end of the groove H1202 and at the edge of the orifice plate H1101. The surface of such a liquid jet recording head was soaked in black ink containing carbon black pigment as color material, and was left for five days under an environment at a temperature of 60° C. and at a humidity of 90%. Next, the liquid jet recording head was left for 300 hours under an environment at a temperature of 60° C. and at a humidity of 90% with a voltage of 24 V applied to the test terminal. After that, the test terminal was checked in detail, and no corrosion was observed. FIG. 5C is a top view of the test terminal and its vicinity of the recording element substrate H1052 after the test. Peeling H1240 of the orifice plate H1101 from the substrate H1110 was observed. However, a peeling extending from the edge of the orifice plate H1101 to the test terminal was not observed.

Disposing each end of the groove H1202 away from the edge of the orifice plate H1101 is effective in preventing a peeling at each end of the groove H1202 and a peeling at the edge of the orifice plate H1101 from joining and developing into a larger peeling.

To locate each end of the groove H1202 nearer to the middle in the width direction of the orifice plate H1101 than the other part of the groove H1202 is, the groove H1202 can have turning parts. In this case, it is desirable that the turning parts should be formed not at a right angle but in a curve to relax the stress concentration in the turning parts. In this example, the turning parts of the groove H1202 are formed in a curve. The diameter of curvature of the inner edge is about 51.5 μm, and the diameter of curvature of the outer edge is about 81.5 μm.

Second Embodiment

In this embodiment, as in the first embodiment, each end of the groove formed in the orifice plate is located nearer to the middle of the orifice plate than the other part of the groove is. The test terminal was checked for corrosion.

Figure 6A:
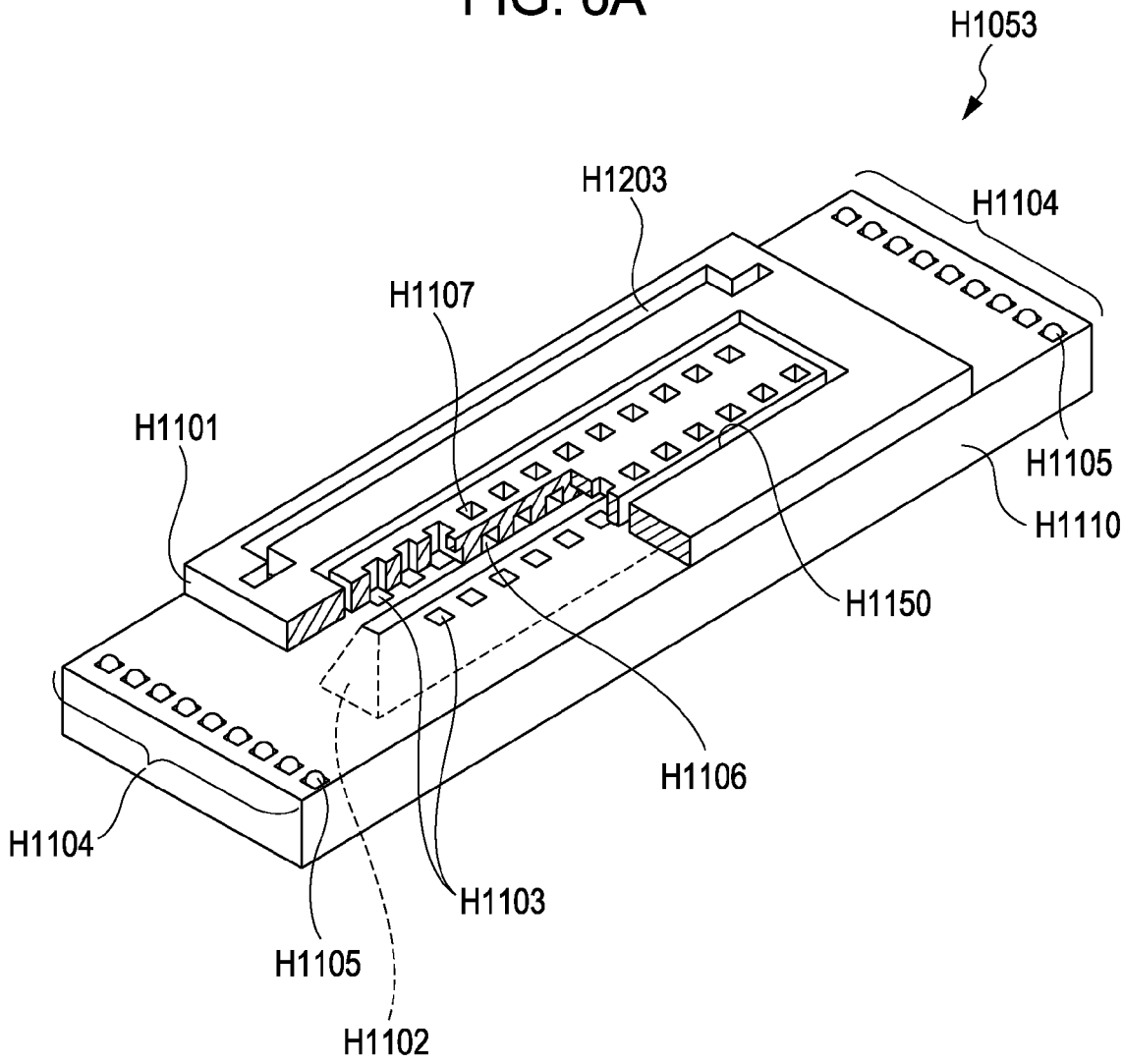
FIGS. 6A to 6C are illustrations of a liquid jet recording head of a second embodiment.

The basic configuration of this embodiment is the same as that of the first embodiment. FIG. 6A is a partially cutaway perspective view for illustrating the configuration of a recording element substrate H1053 of this embodiment.

Figure 6B:
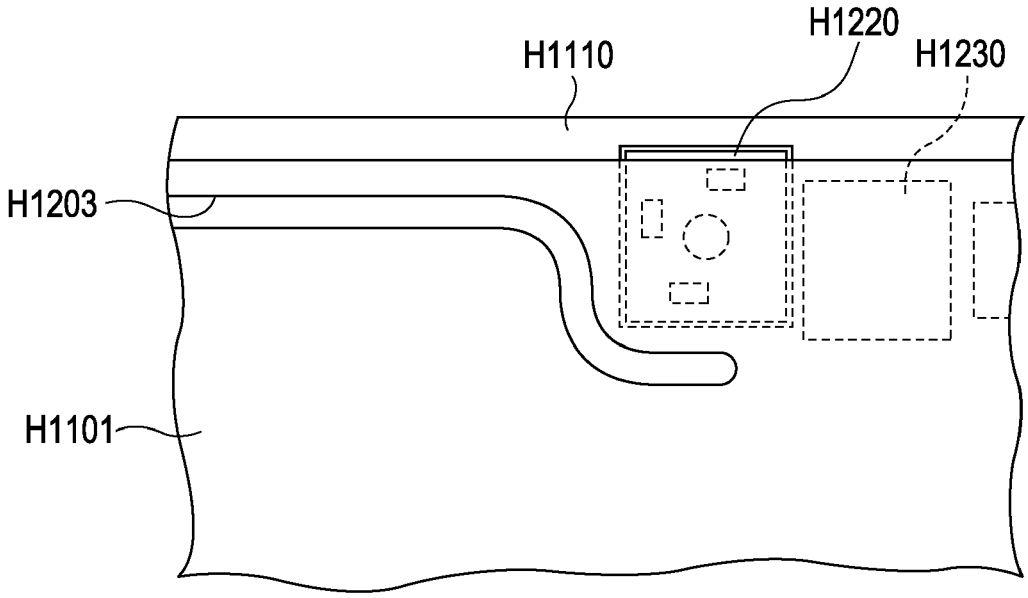

FIG. 6B is a top view of the vicinity of one end in the longitudinal direction of the recording element substrate H1053. The groove H1203 is configured so that each end is located nearer to the middle of the orifice plate H1101 than the other part of the groove H1202 is. In this embodiment, compared to the first embodiment, peeling at the edge of the orifice plate H1101 is reduced by extending each end of the groove H1203 along the longitudinal direction. Each end of the groove H1203 is parallel to the longitudinal direction of the orifice plate H1101. The groove H1203 has a width of about 30 μm.

A liquid jet recording head was made using such a recording element substrate H1053. After making, the head was checked for peeling of the orifice plate H1101 from the substrate H1110. No large peeling was observed. The head was further checked in more detail. Minute peeling was observed at each end of the groove H1203 and at the edge of the orifice plate H1101. However, the degree of peeling at the edge of the orifice plate H1101 was lower than that of the first embodiment.

Figure 6C:
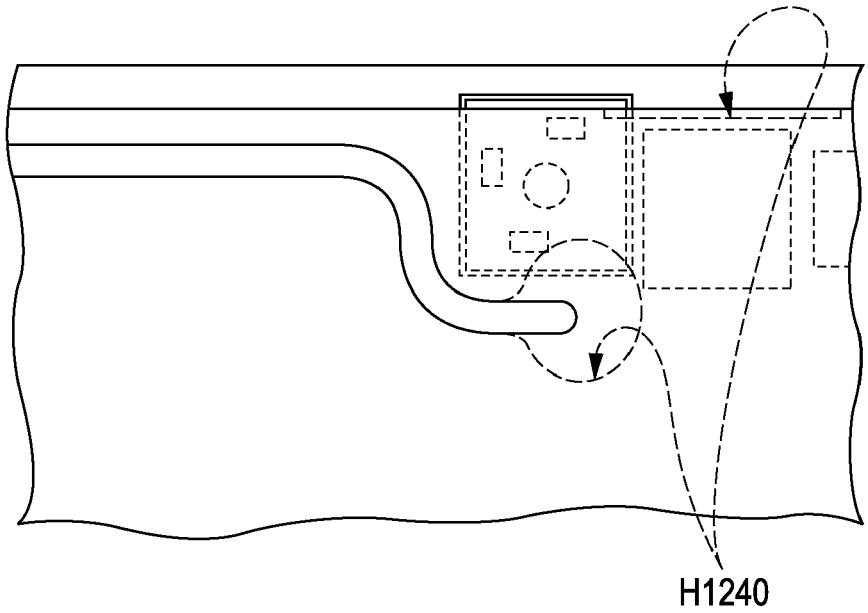

Such a liquid jet recording head underwent the same test as in the first embodiment. After that, the test terminal was checked in detail, and no corrosion was observed. FIG. 6C is a top view of the test terminal and its vicinity of the recording element substrate H1053 after the test. Peeling H1240 of the orifice plate H1101 from the substrate H1110 was observed. However, a peeling extending from the edge of the orifice plate H1101 to the test terminal was not observed.

Disposing each end of the groove H1203 away from the edge of the orifice plate H1101 is effective in preventing a peeling at each end of the groove H1203 and a peeling at the edge of the orifice plate H1101 from joining and developing into a larger peeling.

When the groove has a plurality of turning parts, it is desirable that the turning parts should be formed not at a right angle but in a curve, as in the first embodiment. In this example, the turning parts of the groove H1203 are formed in a curve. The diameter of curvature of the inner edge is about 51.5 μm, and the diameter of curvature of the outer edge is about 81.5 μm.

Third Embodiment

In a third embodiment, as in the first embodiment, each end of the groove formed in the orifice plate is located nearer to the middle of the orifice plate than the other part of the groove is. The test terminal was checked for corrosion.

Figure 7A:
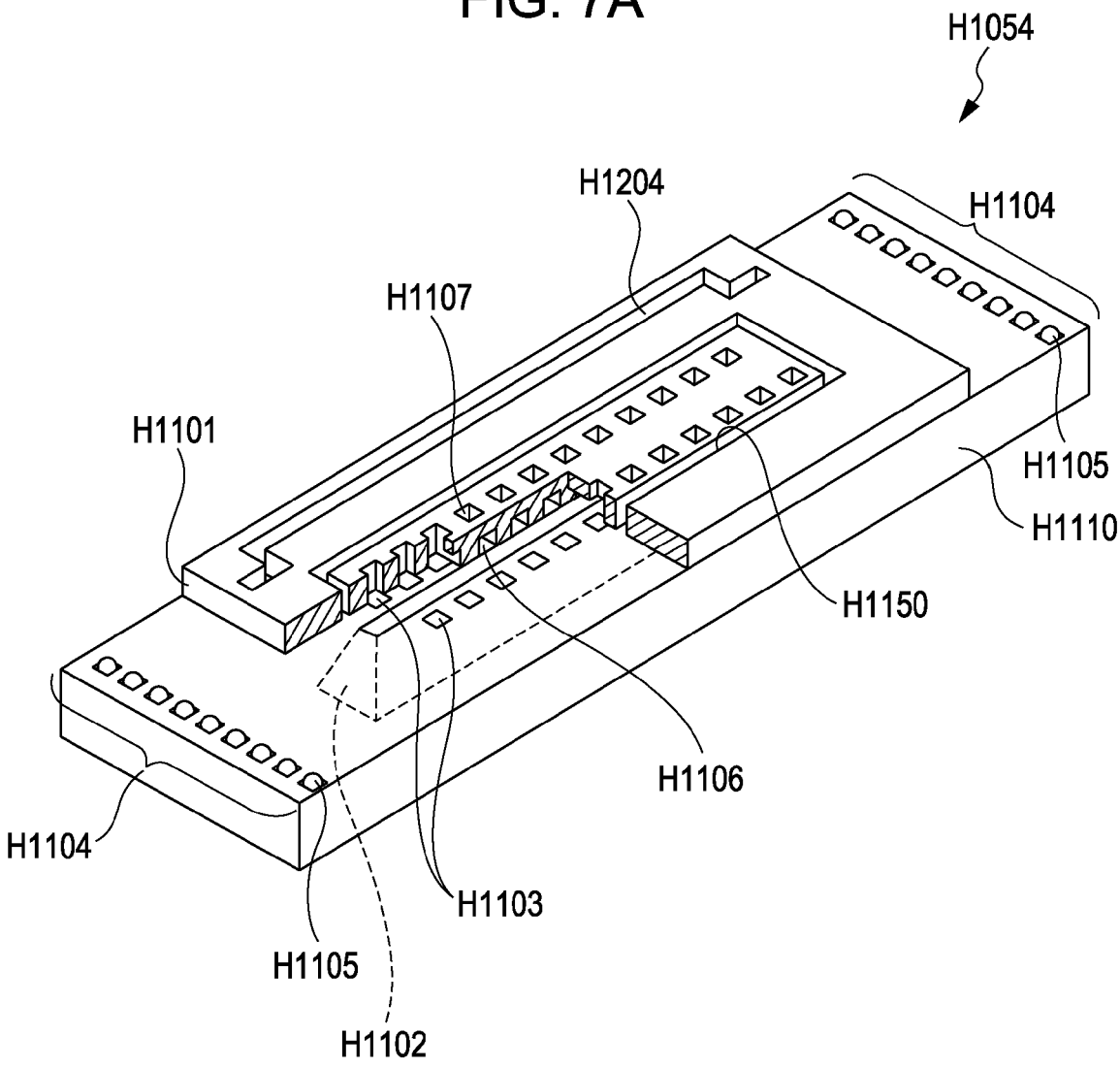
FIGS. 7A to 7C are illustrations of a liquid jet recording head of a third embodiment.

The basic configuration of this embodiment is the same as that of the first embodiment. FIG. 7A is a partially cutaway perspective view for illustrating the configuration of a recording element substrate H1054 of this embodiment.

Figure 7B:
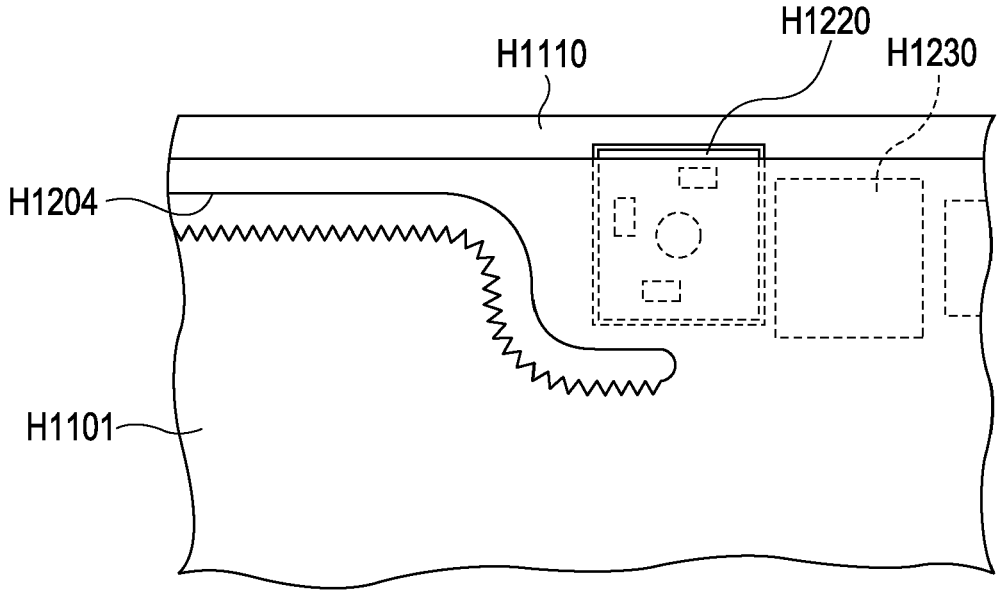

FIG. 7B is a top view of the vicinity of one end in the longitudinal direction of the recording element substrate H1054. The groove H1204 is configured so that each end is located nearer to the middle of the orifice plate H1101 than the other part of the groove H1204 is. In this embodiment, compared to the first embodiment, peeling at the edge of the orifice plate H1101 is reduced by extending each end of the groove H1204 in the longitudinal direction of the groove H1204.

The inner edge of the groove H1204, that is, the edge of the groove H1204 facing the middle of the orifice plate H1101 is formed in a saw-toothed wavy shape. Peaks of this wavy shape are each about 15 μm in height and about 21μm in width and are arranged at a pitch of about 21 μm. The distance between each peak and the outer edge of the groove H1204 is about 35 μm. That is, the width of the groove H1204 is about 35 μm at the peaks of the wave shape and about 20 μm at the valleys of the wave shape.

A liquid jet recording head was made using such a recording element substrate H1054. After making, the head was checked for peeling of the orifice plate H1101 from the substrate H1110. No large peeling was observed. The head was further checked in more detail. Minute peeling was observed at each end of the groove H1204 and at the edge of the orifice plate H1101. However, the degree of peeling at the edge of the orifice plate H1101 was lower than that of the first embodiment. The degree of peeling at each end of the groove H1204 was lower than that of the second embodiment.

Figure 7C:
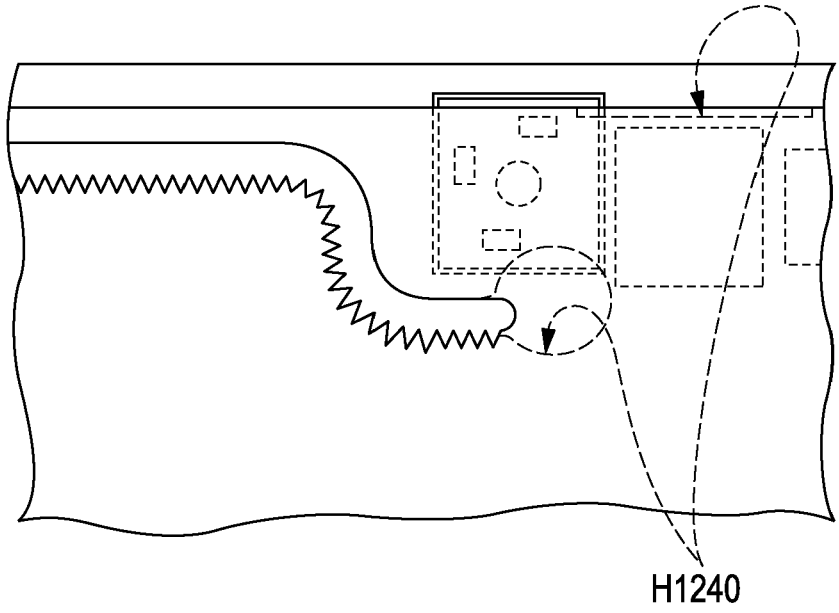

Such a liquid jet recording head underwent the same test as in the first embodiment. After that, the test terminal was checked in detail, and no corrosion was observed. FIG. 7C is a top view of the test terminal and its vicinity of the recording element substrate H1054 after the test. Peeling H1240 of the orifice plate H1101 from the substrate H1110 was observed. However, a peeling extending from the edge of the orifice plate H1101 to the test terminal was not observed.

Disposing each end of the groove H1204 away from the edge of the orifice plate H1101 is effective in preventing a peeling at each end of the groove H1204 and the peeling at the edge of the orifice plate H1101 from joining and developing into a larger peeling.

It is to be understood that the present invention is not intended to be limited to the above-described embodiments, and various changes may be made therein without departing from the spirit of the present invention.

The liquid jet recording head according to the present invention can be applied to a common printer, a copier, a facsimile machine having a communication system, a word processor having a printing section, and a multifunction recording apparatus that incorporates these devices.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-194874 filed Jul. 29, 2008, which is hereby incorporated by reference herein in its entirety.

What is claimed is:

1. A liquid jet recording head comprising:

a substrate on which are formed recording elements that generate energy for ejecting liquid; and a flow passage forming member that is in contact with the substrate and in which are formed ejection ports that eject liquid and flow passages that supply liquid to the ejection ports, wherein the flow passage forming member has a groove formed along the longitudinal direction of the flow passage forming member, and each end of the groove is located nearer to the middle in the width direction of the flow passage forming member than the other part of the groove is.

2. The liquid jet recording head according to claim 1, wherein the thickness of the flow passage forming member is 30 μm or more.

3. The liquid jet recording head according to claim 1, wherein the flow passage forming member is formed of resin.

4. The liquid jet recording head according to claim 1, wherein each end of the groove is parallel to the longitudinal direction of the flow passage forming member.

5. The liquid jet recording head according to claim 1, wherein the edge of the groove that faces the middle in the width direction of the flow passage forming member is formed in a wavy shape along the longitudinal direction of the groove.

* * * * *